US008192238B2

(12) United States Patent
Majewski

(10) Patent No.: US 8,192,238 B2
(45) Date of Patent: Jun. 5, 2012

(54) SERVICE SWITCHING DEVICE WITH A CONNECTION TERMINAL ARRANGEMENT

(75) Inventor: Joachim Majewski, Dossenheim (DE)

(73) Assignee: ABB AG, Mannheim (DE)

( * ) Notice: Subject to any disclaimer, the term of this patent is extended or adjusted under 35 U.S.C. 154(b) by 0 days.

(21) Appl. No.: 13/209,787

(22) Filed: Aug. 15, 2011

(65) Prior Publication Data

US 2012/0052749 A1 Mar. 1, 2012

(30) Foreign Application Priority Data

Aug. 24, 2010 (DE) ..... 10 2010 035 250
Apr. 12, 2011 (DE) ..... 10 2011 016 753

(51) Int. Cl.
*H01R 4/36* (2006.01)

(52) U.S. Cl. ..... 439/813; 439/801

(58) Field of Classification Search ..... 439/801, 439/810, 813
See application file for complete search history.

(56) References Cited

U.S. PATENT DOCUMENTS

| | | | | |
|---|---|---|---|---|
| 5,580,286 | A * | 12/1996 | Kramer et al. | 439/813 |
| 6,293,830 | B1 * | 9/2001 | Park et al. | 439/801 |
| 7,241,152 | B2 * | 7/2007 | Charrier et al. | 439/97 |
| 7,381,102 | B2 * | 6/2008 | Camacho | 439/801 |
| 7,704,105 | B2 * | 4/2010 | Bitz et al. | 439/810 |
| 2004/0005823 | A1 * | 1/2004 | An | 439/801 |
| 2009/0053927 | A1 | 2/2009 | Bitz et al. | |
| 2010/0227513 | A1 | 9/2010 | Bitz et al. | |

FOREIGN PATENT DOCUMENTS

| | | |
|---|---|---|
| DE | 695 16 034 T2 | 1/2001 |
| DE | 10 2007 039 709 A1 | 2/2009 |

* cited by examiner

*Primary Examiner* — Tho D Ta
(74) *Attorney, Agent, or Firm* — Buchanan Ingersoll & Rooney PC

(57) ABSTRACT

The disclosure relates to a service switching device with an insulating housing and a connection terminal arrangement for the terminal connection of a connecting conductor with an annular terminal lug on a connecting plate mounted in the device interior, with a clamping screw, which has a screw head and a screw shaft, the screw shaft passing through the annular terminal lug and being in threaded engagement with a thread element during the terminal connection of the connecting conductor. A terminal accommodating area has an insertion opening for the connecting conductor and an access opening for the screw head for actuation thereof. The connecting plate has a holding section for locking the thread element.

16 Claims, 5 Drawing Sheets

SERVICE SWITCHING DEVICE WITH A CONNECTION TERMINAL ARRANGEMENT

RELATED APPLICATION(S)

This application claims priority under 35 U.S.C. §119 to German Patent Application No. 10 2010 035 250.0 filed in Germany on Aug. 24, 2010, and German Patent Application No. 10 2011 016 753.6 filed in Germany on Apr. 12, 2011, the entire contents of which are hereby incorporated by reference in their entirety.

FIELD

The present disclosure relates to a service switching device with an insulating housing and a connection terminal arrangement for a terminal connection of a connecting conductor. The connecting conductor includes an annular terminal lug on a connecting plate for mounting in an interior of the service switching device, with a clamping screw. The clamping screw has a screw head and a screw shaft. The screw shaft passes through the annular terminal lug and is in threaded engagement with a thread element during the terminal connection of the connecting conductor. A terminal accommodating area includes an insertion opening for the connecting conductor and an access opening for the screw head for actuation thereof.

BACKGROUND INFORMATION

Known service switching devices can be, for example, line circuit breakers, motor circuit breakers or residual current circuit breakers, whose connection terminal arrangement can be designed specifically for connecting a connecting conductor with a so-called annular terminal lug, for example with a terminal lug with a closed ring. A hole can be located in the annular terminal lug, wherein the clamping screw is guided through the hole during clamping.

DE 10 2007 039 709 A1 discloses a service switching device in which a thread element, with which a screw shaft can be engaged, is in the form of a threaded bore in a connecting plate. The clamping screw is screwed directly to the connecting plate. In this case, the connecting plate is provided with a corresponding thickness and stability in order for it to be able to absorb even a relatively large clamping torque when the clamping screw is tightened without being distorted or without the thread breaking. This can involve relatively high material costs and relatively complex manufacture.

DE 695 16 034 T2 discloses a service switching device, in which a thread element is in the form of a nut, which is held in a nut accommodating cutout in a housing. The clamping screw is screwed to an additional part, a nut, and not directly to a connecting plate. Nevertheless, the nut applies the entire force to housing parts in which the nut is mounted in locking fashion when the clamping screw is tightened. This can result in excessive loading on the housing and in distortion or even breakage of housing parts.

SUMMARY

A service switching device is disclosed which comprises an insulating housing, and a connection terminal arrangement for terminal connection of a connecting conductor. The connection terminal arrangement includes an annular terminal lug on a connecting plate for mounting in an interior of the service switching device, a thread element, a clamping screw, including a screw head and a screw shaft for passing through the annular terminal lug and being in threaded engagement with the thread element during a terminal connection of the connecting conductor, a terminal accommodating area accessible by an insertion opening in the housing for receiving the connecting conductor, and an access opening in the housing for actuation of the screw head, wherein the connecting plate has a holding section for locking the thread element.

BRIEF DESCRIPTION OF THE DRAWINGS

The disclosure will be explained and described in more detail with reference to the drawings, in which exemplary embodiments of the disclosure are illustrated and in which.

DETAILED DESCRIPTION

Figure 1:
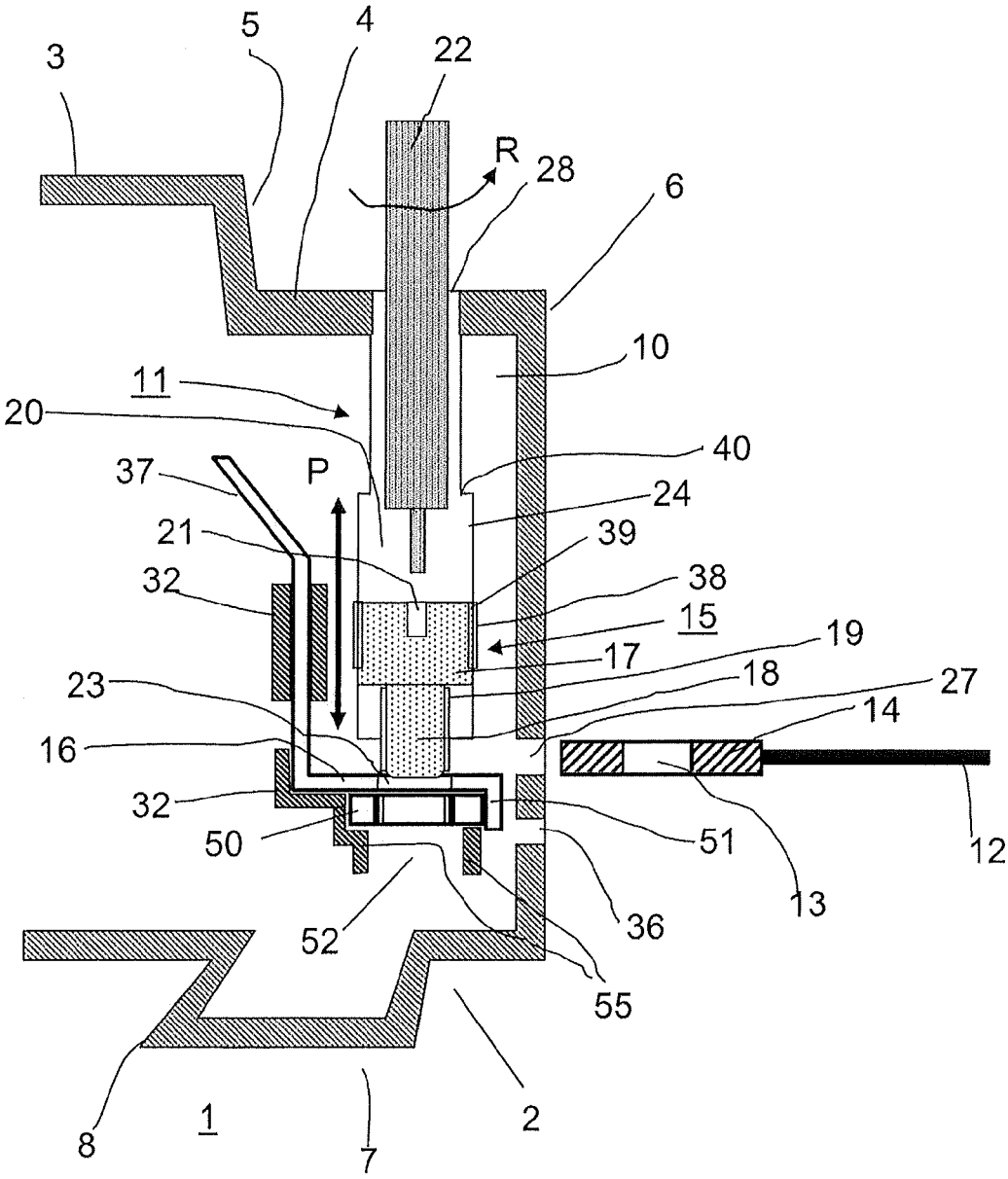
FIG. 1 shows a first exemplary embodiment of the disclosure in a schematic illustration.

In an exemplary embodiment, a service switching device is disclosed that, given a simple and manufacturing-friendly configuration of a connecting plate, can avoid loading on a housing when a clamping screw is tightened for the purpose of connecting a connecting conductor with an annular terminal lug.

According to an exemplary embodiment, the connecting plate has a holding section for locking a thread element. The thread element can be in the form of a separate part, independent of the connecting plate, for example, in the form of a nut. The connecting plate itself does not have a thread for the clamping screw but only a plug-through hole, through which a screw shaft of the clamping screw can be plugged in order to screw the clamping screw to the thread element. The thread element is held in its position by the holding section on the connecting plate. A clamping torque of the clamping screw is therefore absorbed via the holding part by the connecting plate, and the housing parts of the service switching device are not subjected to a load. The holding section can be configured in such a way that it distributes a clamping force of the clamping screw as widely as possible over the cross section of the connecting plate, with the result that local force peaks can be avoided. Thus, a risk of distortion of the connecting plate can be reduced. Because the connecting plate itself can be formed without a dedicated thread, it can be produced from a high-grade metal with a high degree of electrical conductivity. For example, copper can be used but with a low material thickness, which can result in reduced costs owing to the thus reduced material requirement. Nevertheless, a high clamping torque of the clamping screw is possible owing to the separately designed thread element.

In accordance with an exemplary embodiment of the disclosure, a terminal accommodating area has a first cutout with boundary walls for accommodating the thread element. This can facilitate insertion of the thread element and makes it possible for the thread element to be inserted independently of the connecting conductor even before the connecting conductor is supplied and held in the terminal accommodating area.

In accordance with an exemplary embodiment of the disclosure, the boundary walls of the first cutout have a recess towards the thread element, with the result that the thread element can be accommodated in the cutout in rotationally movable fashion. A rotary angle is limited by the thread element bearing in locking fashion against the holding section of the connecting plate. The special housing contour of the recess can prevent the thread element from applying the entire force to the housing parts when the clamping screw is tightened because the thread element itself can always be locked by the metallic holding section on the connecting plate and not by a housing part. Therefore a relatively large clamping torque can be achieved without excessive loading on the housing.

In accordance with an exemplary embodiment of the disclosure, the holding section(s) can be a web which is formed integrally in the form of an L or U at the free end of the connecting plate.

In accordance with an exemplary embodiment of the disclosure, the holding section can be an end section, which can be integrally formed on the connecting plate, with a second cutout for accommodating the thread element in locking fashion.

In accordance with an exemplary embodiment of the disclosure, the thread element is a nut with an internal thread, for example a square nut.

Figure 2:
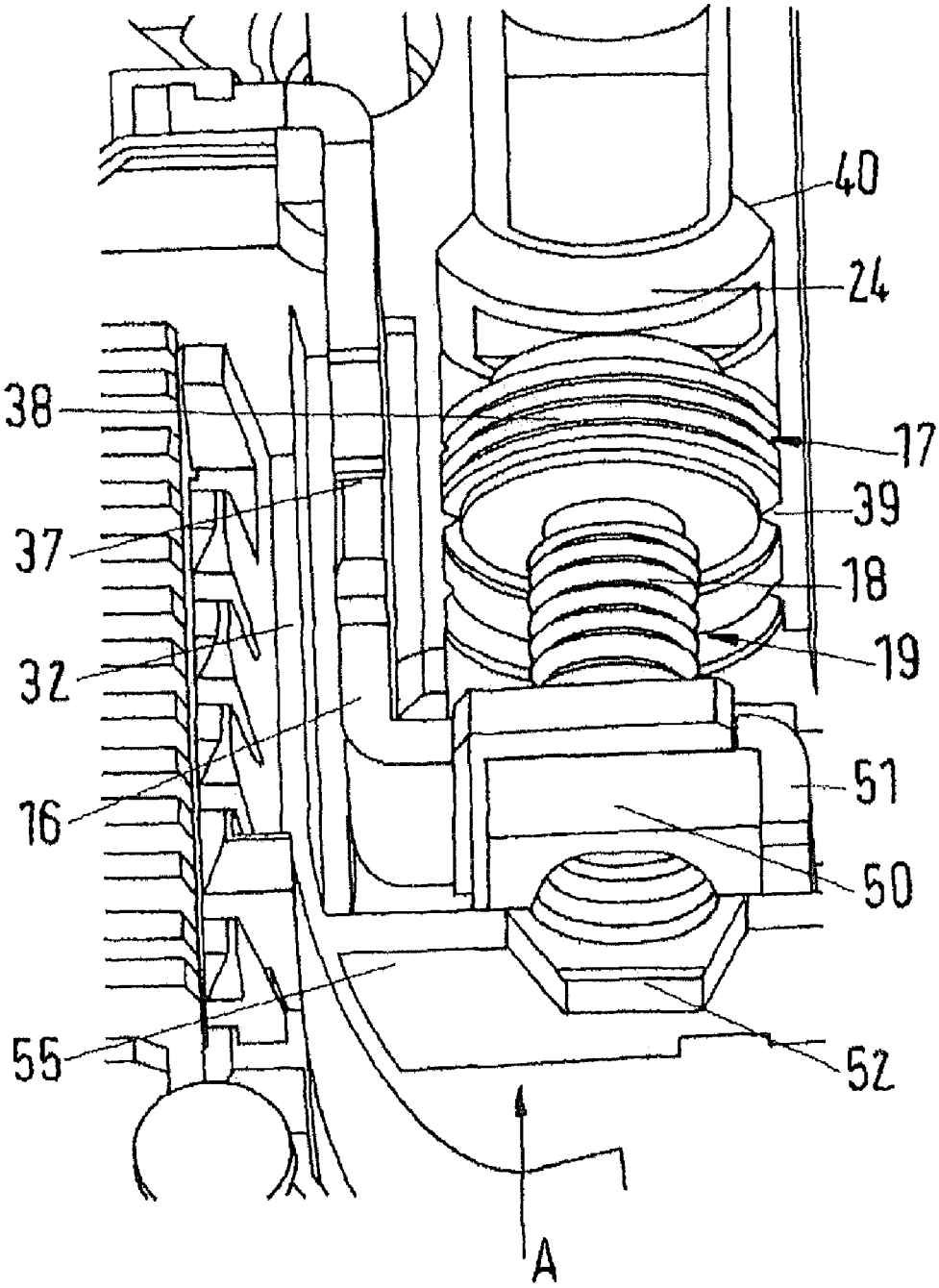
FIG. 2 shows a detailed view of the terminal accommodating area of the embodiment shown in FIG. 1.

FIG. 1 shows, schematically and as a partial section, an exemplary embodiment of a service switching device 1, which has an insulating housing 2. FIG. 2 shows a detailed view of the terminal accommodating area of the embodiment shown in FIG. 1. The service switch device 1 can be a line circuit breaker, for example. The insulating housing of the line circuit breaker includes a front and rear front-panel side 3, 4, a front and rear narrow side 5, 6 and a fastening side 7. A fixed tab 8 is fitted on the fastening side 7 and interacts with a further, generally movable tab when the line circuit breaker 1 is fixedly clamped on a mounting rail.

A terminal accommodating area 10 is provided in the region of the rear narrow side 6 in the housing 2, with a connection terminal arrangement 11 accommodated in the terminal accommodating area. The terminal accommodating area 10 is accessible on the rear narrow side 6 through an insertion opening 27 for a connecting conductor 12 and on the rear front-panel side 4 through an access opening 28 for an actuating tool, for example, a screwdriver 22.

The connecting conductor 12, which bears an annular terminal lug 14 with a central opening 13, can be fixedly screwed to the connection terminal arrangement 11 by a clamping screw 15 on a connecting plate 16.

The clamping screw 15 has a screw head 17 in the form of an elongate cylinder and a shaft 18. The shaft 18 bears an external thread 19. A slot 21 for accommodating the actuating tool, for example, a screwdriver 22, is provided in the free end face of the screw head 17.

The connecting plate 16 bears a hole 23. The connecting plate is aligned approximately parallel to the rear front-panel side 4. The connecting plate 16 can be integrally formed on a discharge rail 37, to which further electrical conductors emerging into the interior of the service switching device 1 can be connected. However, the electrical conductors, as well as the other further components and assemblies required for the operation of a service switching device, such as a thermal and electromagnetic release, a switching mechanism, a switching lever with a contact point, an arc quenching arrangement, etc., are not illustrated here.

The discharge rail 37 and the connecting plate 16 can be mounted fixed in terms of location in the housing 2 of the service switching device 1 by web-like housing projections 32.

The clamping screw 15 is guided in an approximately cylindrical guide channel 24 in the terminal accommodating area 10. The guide channel 24 runs approximately parallel to the rear narrow side 6, with the result that the clamping screw 15 is guided through the guide channel perpendicularly towards the hole 23 in the connecting plate 16.

FIG. 1 shows the clamping screw 15 in a fitting position wherein, for example, the free end of the screw shaft 18 is located substantially at the height of the hole 23. In this position, the annular terminal lug 14 cannot be inserted into the terminal accommodating area 10 because it would be blocked by the screw shaft 18. Prior to the insertion of the terminal lug, the clamping screw 15 can be raised upwards from the connecting plate 16 so far in the direction of the arrow P that a space is opened up between the free end of the shaft 18 and the connecting plate 16 which at least corresponds to the thickness of the terminal lug 14, with the result that, then, the terminal lug 14 can be pushed through the insertion opening 27 until its opening 13 comes to lie precisely over the hole 23.

Here, the discharge rail 37 is provided with the second function of stopping the insertion of the terminal lug 14, as a result of which excessive insertion of the terminal lug can be avoided and thus fitting of the connecting conductor 12 can be facilitated.

The screw head 17 bears an external thread 38 in its upper part. An internal thread 39 or a housing contour (e.g., a partial thread), with a thread function is introduced on the inner wall of the guide channel 24. This starts in the lower part of the guide channel 24 (see FIG. 2). When the clamping screw 15 is moved from the top in the direction towards the hole 23 in the connecting plate 16, it first slides along the inner wall of the guide channel 24 in the upper section thereof and, in the lower part, engages in the internal thread 39 with its external thread as it rotates. The further movement of the clamping screw 15 can then now only be performed by rotation and corresponding screw guidance in the internal thread 39. As a result, centred guidance of the clamping screw towards the hole 23 can be ensured.

The clamping screw 15 can be prevented from being lost once it has been unscrewed from the internal thread 39 by an undercut 40 in the guide channel 24. The undercut 40 can be in the form of an annular bead or a cross-sectional tapering of the guide channel 24 towards the top. The cross-sectional area of the guide channel 24, which is reduced by the undercut 40, can still be sufficiently large for a screwdriver 22 to be able to pass through in order to actuate the clamping screw 15, but is smaller than the cross section of the screw head, with the result that the screw head is caught in the guide channel 24 such that it can be made difficult to lose. When the clamping screw 15 has been pushed upwards into the guide channel 24, once it has been unscrewed from the internal thread 39, the open position of the screw can be reached. In this position, the clamping screw 25 does not have any threaded engagement and cannot exert any disruptive pressure on the housing as the screw is rotated and can automatically ensure the fixed position of the connecting conductor.

A thread element 50, in this case in the form of a square nut, with a threaded hole and an internal thread is located on that side of the connecting plate 16 which is opposite the clamping screw 15.

As the clamping screw 15 is rotated further, the screw is guided through the hole 23 by centred guidance and the threaded engagement between the external thread 19 on the shaft 18 and the internal thread of the thread element 15 can be automatically achieved. By virtue of this threaded engagement, the clamping screw 15 can be drawn further into the thread element 50 as it is rotated further until the terminal lug 14 is clamped fixedly between the screw head 17 and the connecting plate 16. In this way, a fixed screw connection with good areal contact can be produced.

The terminal accommodating area 10 has a first cutout 52 with boundary walls 55 for accommodating the thread element 50. This facilitates the insertion of the thread element 50 and can make it possible for the thread element 50 to be inserted independently of the connecting conductor and even before the connecting conductor is supplied and to be held in the terminal accommodating area. Nevertheless, the thread element 50 is in this case not held fixedly in locking fashion by the boundary walls 55 of the first cutout 52 when the clamping screw 15 is screwed in and a clamping torque is produced on the thread element 50. As a result of the thread element 50 can tend to rotate in the first cutout 52.

In order to hold the thread element 50 in locking fashion, the connecting plate 16 has, at its free end, a web 51, which can be integrally formed in the form of an L and acts as holding section 51 for locking the thread element, e.g. the square nut 50. The thread element 50 can be held in its position by the holding section 51 on the connecting plate 16. The clamping torque of the clamping screw 15 can therefore be absorbed via the holding part 51 of the connecting plate 16, and the housing parts of the service switching device may not be subjected to any load.

Figure 4:
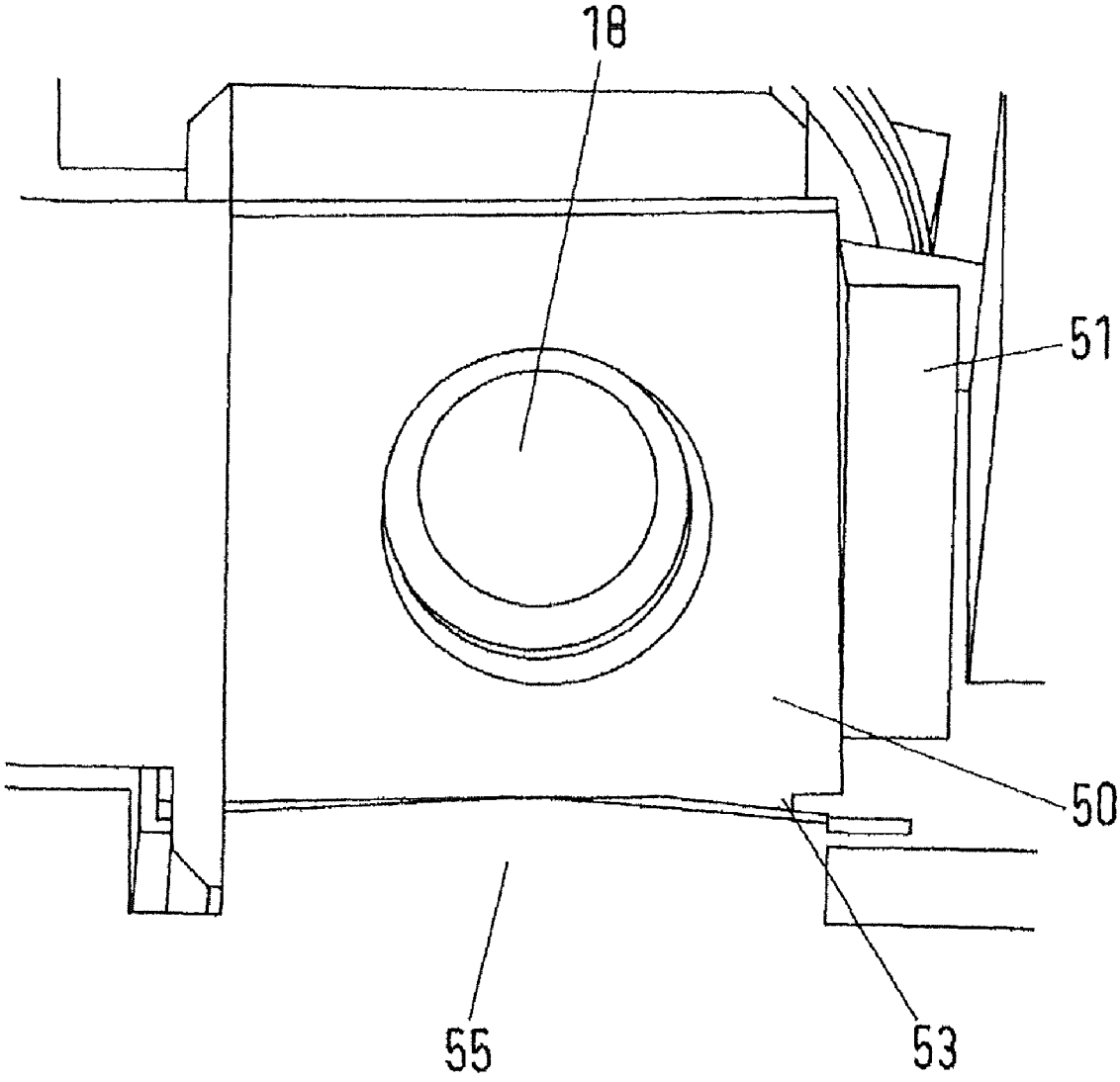
FIG. 4 shows a detailed view from below in arrow direction A of the nut with the clamping screw screwed therein in accordance with the embodiment shown in FIG. 2.

FIG. 4 shows that the boundary wall 55 of the first cutout 52 has a recess 53 towards the thread element 50, with the result that the thread element 50 is accommodated in rotationally movable fashion in the first cutout 52. The rotary angle is limited by the thread element bearing in locking fashion against the holding section 51 of the connecting plate 16. The boundary wall 55 has substantially the form of a roof with sloping roof surfaces in cross section. The square nut 50 can be rotated about the point of the roof into the recesses 53 formed between the sloping roof surfaces and the side walls of the square nut. However, before the side wall of the square nut 50 comes to bear against one of the sloping roof surfaces, further rotation of the square nut 50 can be prevented by bearing against the holding section 51. Thus, there can always be a recess 53 between the side wall of the square nut 50 and the boundary walls 55 of the first cutout 52. The clamping force or the clamping torque which is transferred via the square nut from the clamping screw 18 does not act on the boundary walls 55, but instead acts on the holding section 51 and therefore on the connecting plate 16. The special housing contour of the recess 53 can prevent the thread element 50 from applying the entire force onto the housing parts 55 when the clamping screw 18 is screwed tightly because the thread element 50 itself is locked always by the metallic holding section 51 on the connecting plate 16 and not by a housing part. Therefore a relatively large clamping torque can be achieved without excessive loading on the housing.

Figure 3:
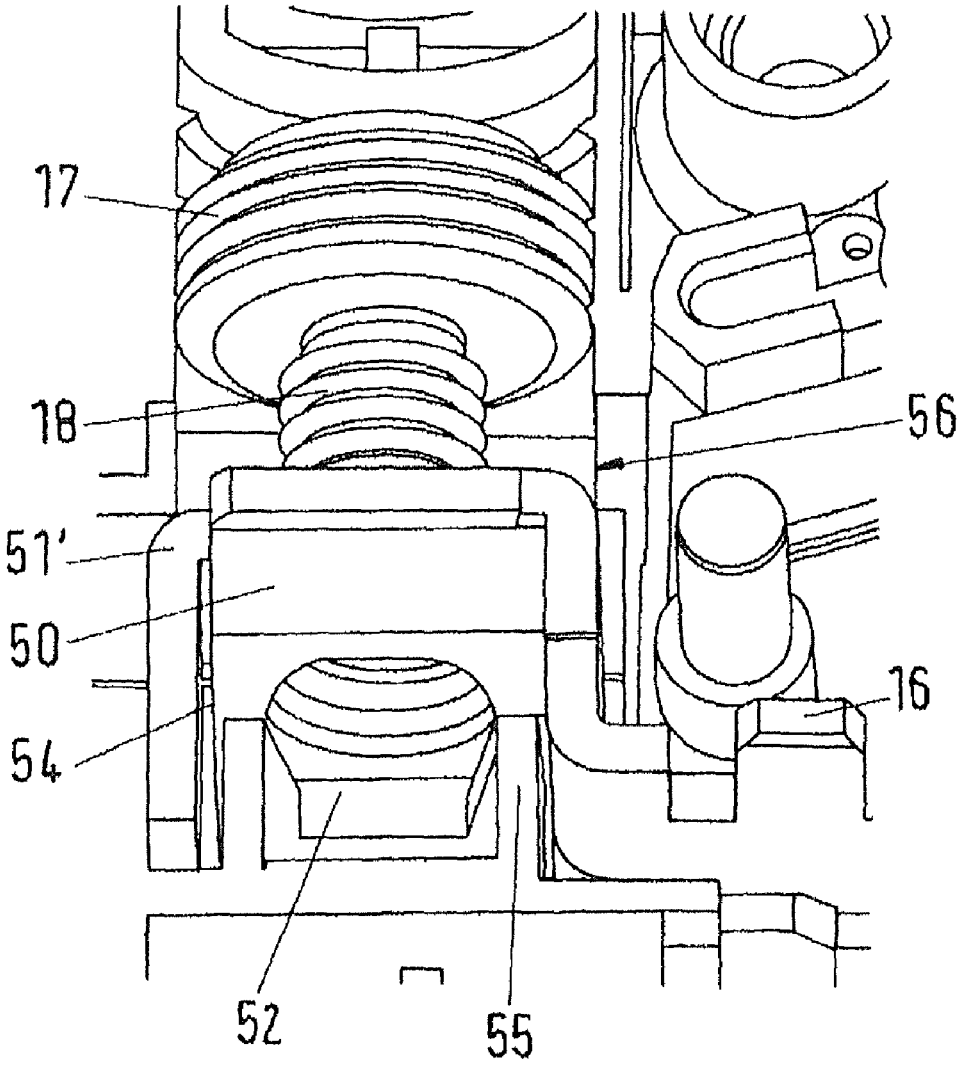
FIG. 3 shows a detailed view of the terminal accommodating area of a second exemplary embodiment of the disclosure shown in FIG. 5.
Figure 5:
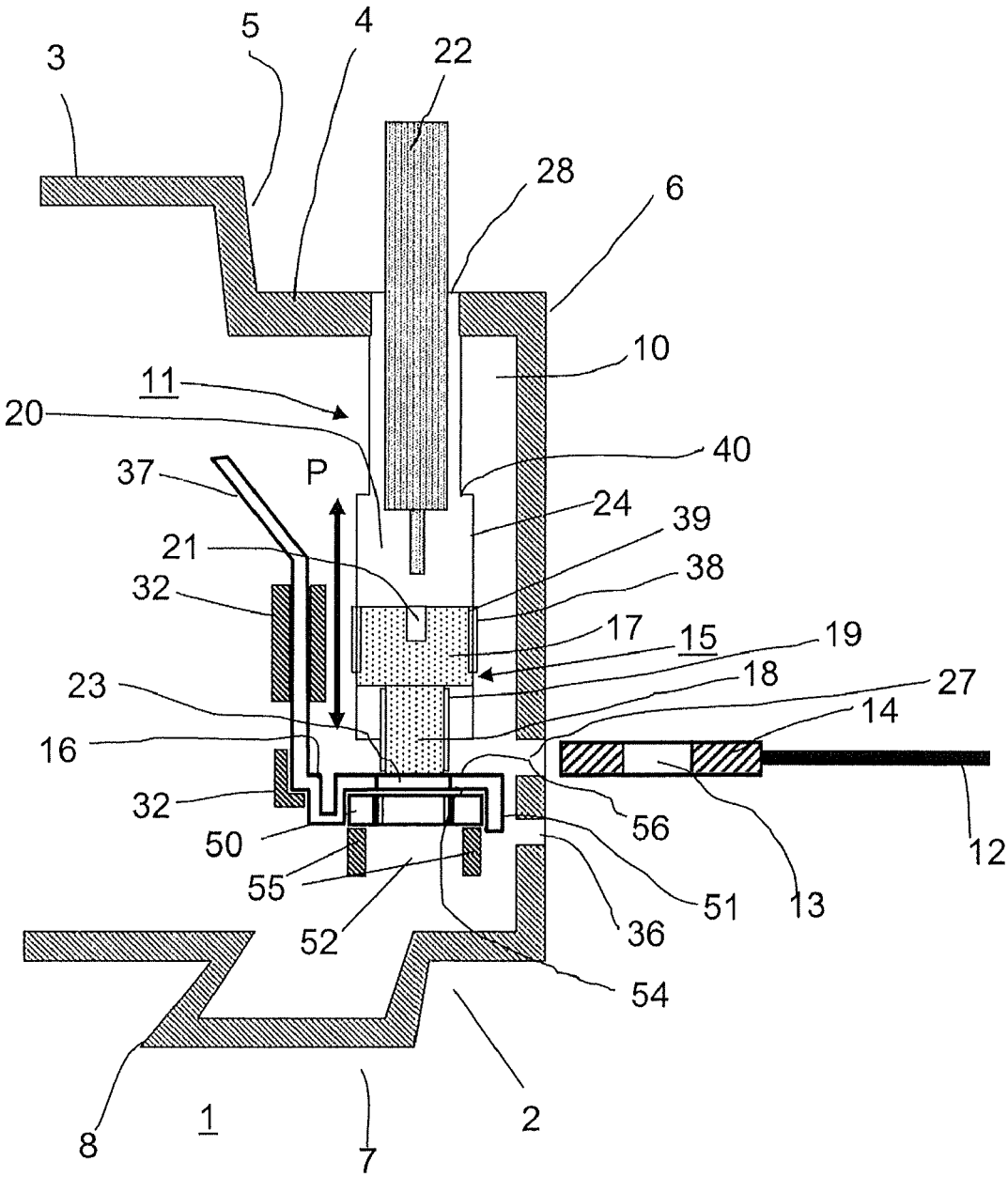
FIG. 5 shows the second exemplary embodiment of the disclosure in a schematic illustration.

In the exemplary embodiment shown in FIGS. 5 and 3, the holding section 51' can be an end section 56, which is integrally formed on the connecting plate 16, with a second cutout 54 for accommodating the thread element in locking fashion. The end section 56 has substantially the form of a U, and the square nut 50 can be held in locking fashion between the two longitudinal limbs of the U form.

Because the connecting plate with the U-shaped end section or the L-shaped web can be embodied without a dedicated thread when using an inexpensive thread element, for example, an inexpensive square nut 50, it is possible to decrease the material thickness (and save costs) of a high-grade metal (for example copper) with good electrical conductivity and clamping torque of the clamping screw 15.

The thread element 50 can have a slight play with respect to the holding section 51, 51', and can be screwed in more easily by virtue of the play of the thread element with the U or L form and can also remain easy to operate by virtue of tolerance-related axial offset between the clamping screw 15 and the threaded hole in the thread element 50.

A desirable feature owing to the U or L form of the holding section 51, 51' of the connecting plate 16 can be that there is no need for a reduction in the cross section of the metal (for example locking holes or fixing tabs for fixably holding the thread element). This can have a positive effect on clamping torques and the electrical conductivity.

The terminal arrangement 11 can also be preassembled, with efficient manufacture, inexpensively and in a simple manner prior to being installed in the device.

The connecting plate 16 can be arranged in the housing in such a way that the holding section 51, 51' comes to lie in the vicinity of the rear narrow side 6 and can be accessible from the outside through a test opening 36 for making contact for test or calibration purposes by a test probe.

In this case, the present disclosure also includes any desired combinations of exemplary embodiments and individual configuration features or developments insofar as these are not mutually exclusive.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

List of reference symbols

| | |
|---|---|
| 1 | Service switching device |
| 2 | Insulating housing |
| 3 | Front front-panel side |
| 4 | Rear front-panel side |
| 5 | Front narrow side |
| 6 | Rear narrow side |
| 7 | Fastening side |
| 8 | Fixed tab |
| 10 | Terminal accommodating area |
| 11 | Connection terminal arrangement |
| 12 | Terminal block |
| 13 | Opening in terminal lug |
| 14 | Annular terminal lug |
| 15 | Clamping screw |
| 16 | Connecting plate |
| 17 | Screw head |
| 18 | Shaft |
| 19 | External thread on shaft |
| 20 | End face of screw head |
| 21 | Slot |
| 22 | Screwdriver |
| 23 | Hole in connecting plate |
| 24 | Guide channel in terminal accommodating area |
| 27 | Insertion opening |
| 28 | Access opening |
| 32 | Web-like projections |
| 36 | Test opening |
| 37 | Discharge rail |
| 38 | External thread on screw head |
| 39 | Internal thread in guide channel |

-continued

| List of reference symbols | |
|---|---|
| 40 | Undercut |
| 50 | Thread element |
| 51, 51' | Holding section |
| 52 | First cutout |
| 53 | Recess |
| 54 | Second cutout |
| 55 | Boundary wall |
| 56 | End section |

What is claimed is:

1. A service switching device, comprising:

an insulating housing; and a connection terminal arrangement for terminal connection of a connecting conductor, the connection terminal arrangement including:

an annular terminal lug;

a connecting plate mounted in an interior of the service switching device;

a threaded nut;

a clamping screw, including a screw head and a screw shaft for passing through the annular terminal lug and being in threaded engagement with the threaded nut during a terminal connection of the connecting conductor;

a terminal accommodating area accessible by an insertion opening in the housing for receiving the connecting conductor; and an access opening in the housing for actuation of the screw head, wherein the connecting plate has a holding section that locks the threaded nut in a direction of rotation of the clamping screw.

2. The service switching device of claim 1, in combination with a connecting conductor.

3. The service switching device according to claim 1, wherein the terminal accommodating area has a first cutout for accommodating the threaded nut.

4. The service switching device according to claim 3, wherein the first cutout has a boundary wall including a recess towards the threaded nut, the threaded nut being accommodated in the cutout in rotationally movable fashion, a rotary angle being limited by the threaded nut bearing in locking fashion against the holding section of the connecting plate.

5. The service switching device according to claim 1, comprising:

a guide channel having an inner wall; and an internal thread or a housing contour with a thread function formed on the inner wall, wherein the screw head has an external thread for engagement with the internal thread for centering and guiding the clamping screw towards the connecting plate.

6. The service switching device according to claim 5, comprising:

an undercut provided in the guide channel such that the guide channel has a smaller diameter than the screw head between the undercut and the access opening, for preventing the clamping screw from falling out of the guide channel, and for providing a fitted position of the connecting conductor.

7. The service switching device according to claim 4, wherein the holding section is a web integrally formed as an L at a free end of the connecting plate.

8. The service switching device according to claim 4, wherein the holding section is an end section integrally formed on the connecting plate, with a second cutout for accommodating the threaded nut in locking fashion.

9. The service switching device according to claim 3, comprising:

a guide channel having an inner wall; and an internal thread or a housing contour with a thread function formed on the inner wall, wherein the screw head has an external thread for engagement with the internal thread for centering and guiding the clamping screw towards the connecting plate.

10. The service switching device according to claim 9, comprising:

an undercut provided in the guide channel such that the guide channel has a smaller diameter than the screw head between the undercut and the access opening, for preventing the clamping screw from falling out of the guide channel, and for providing a fitted position of the connecting conductor.

11. The service switching device according to claim 4, comprising:

a guide channel having an inner wall; and an internal thread or a housing contour with a thread function formed on the inner wall, wherein the screw head has an external thread for engagement with the internal thread for centering and guiding the clamping screw towards the connecting plate.

12. The service switching device according to claim 11, comprising:

an undercut provided in the guide channel such that the guide channel has a smaller diameter than the screw head between the undercut and the access opening, for preventing the clamping screw from falling out of the guide channel, and for providing a fitted position of the connecting conductor.

13. The service switching device according to claim 7, comprising:

a guide channel having an inner wall; and an internal thread or a housing contour with a thread function formed on the inner wall, wherein the screw head has an external thread for engagement with the internal thread for centering and guiding the clamping screw towards the connecting plate.

14. The service switching device according to claim 13, comprising:

an undercut provided in the guide channel such that the guide channel has a smaller diameter than the screw head between the undercut and the access opening, for preventing the clamping screw from falling out of the guide channel, and for providing a fitted position of the connecting conductor.

15. The service switching device according to claim 8, comprising:

a guide channel having an inner wall; and an internal thread or a housing contour with a thread function formed on the inner wall, wherein the screw head has an external thread for engagement with the internal thread for centering and guiding the clamping screw towards the connecting plate.

16. The service switching device according to claim 15, comprising:

an undercut provided in the guide channel such that the guide channel has a smaller diameter than the screw head between the undercut and the access opening, for preventing the clamping screw from falling out of the guide channel, and for providing a fitted position of the connecting conductor.

* * * * *